United States Patent [19]

Glomski et al.

[11] Patent Number: 4,919,200

[45] Date of Patent: Apr. 24, 1990

[54] HEAT EXCHANGER WALL ASSEMBLY

[76] Inventors: Stanislas Glomski, Chemin de la Rivière, Saint-Félix de Kinsey, Canada, J0B 2T0; Patrick Roseberry, 3675 Saint-Pierre Street, Drummondville, Canada, J2B 6V2

[21] Appl. No.: 345,307

[22] Filed: May 1, 1989

[51] Int. Cl.[5] ..... F28F 3/02

[52] U.S. Cl. ..... 165/166; 165/167

[58] Field of Search ..... 165/166, 167, 170

[56] References Cited

U.S. PATENT DOCUMENTS

| | | | |
|---|---|---|---|
| 1,826,344 | 10/1931 | Dalgliesh | 165/166 X |
| 2,281,754 | 5/1942 | Dalzell . | |
| 3,471,604 | 10/1969 | Tiefenbacher . | |
| 3,763,090 | 1/1974 | Andersson et al. . | |
| 4,470,453 | 9/1984 | Laughlin et al. . | |
| 4,569,391 | 2/1986 | Hulswitt et al. . | |

FOREIGN PATENT DOCUMENTS

| | | | |
|---|---|---|---|
| 592566 | 2/1960 | Canada . | |
| 1098113 | 3/1981 | Canada . | |
| 53-137460 | 11/1978 | Japan | 165/166 |
| 180892 | 8/1986 | Japan | 165/166 |

*Primary Examiner*—Martin P. Schwadron
*Assistant Examiner*—Allen J. Flanigan

[57] ABSTRACT

A wall assembly consisting of at least an upper, an intermediate and a lower sheet of a rigid material, each sheet being poked with a plurality of similar protuberances and cavities extending on opposite sides of the virtual plane defined by the sheet in alternating fashion, whereby each cavity is surrounded solely by protuberances and each protuberance is surrounded solely by cavities. The sheets are glued to each other in superimposed fashion. Gaps are defined between the sheets, wherein an upper and a lower layer of undulating channels are defined thicknesswisely of the wall assembly. The wall assembly may be used as a structural wall or panel or as a heat exchanger, wherein the channels are arranged in two sets for the passage of two different fluids whereby thermal exchanges therebetween may occur.

9 Claims, 6 Drawing Sheets

HEAT EXCHANGER WALL ASSEMBLY

FIELD OF THE INVENTION

This invention relates to rigid, wall structures, especially for use as heat exchangers.

BACKGROUND OF THE INVENTION

Heat exchangers are wall constructions which include means for facilitating thermal transfers between two or more fluids circulating about the wall construction. A review of the relevant prior art has unveiled the following patents:

U.S. Pat. No. 2,281,754 to Dalzell;
U.S. Pat. No. 1,826,344 to Dalgliesch;
U.S. Pat. No. 3,473,604 to Tiefenbacher;
U.S. Pat. No. 3,783,090 to Andersson et al;
U.S. Pat. No. 4,293,033 to Nasser;
U.S. Pat. No. 4,470,453 to Laughlin et al;
U.S. Pat. No. 4,569,391 to Hulswitt et al;
Canadian patent 592,566 to Andre Huet;
Canadian patent 1,098,113 to Davidson.

These patented heat exchangers are made up of a plurality of plates or sheets which are dimpled in a manner to provide tortuous paths for one liquid in one direction, and tortuous paths in adjacent plates for a second liquid in a second direction transverse or perpendicular to that of the first liquid. Hence, undulating "tubes" are formed.

More specifically, in U.S. Pat. No. 4,293,033 (dated Oct. 6, 1981), there is provided a stack of heat exchanger plates formed by corrugated plates 1, 2, which lie against one another, and form a plate pair (FIG. 2). Each pair of plates 1, 2 define transverse tubular passages 3 which are separated by the thickness of the plates from longitudinal undulating flow passages 4. A bar 5 separates each two pairs of successively superimposed pairs of plates 1, 2. Because of the spacer bars, the required volume to store this heat exchanger wall construction before use remains substantial, and also this construction cannot be easily disassembled/reassembled.

In U.S. Pat. No. 4,569,391 (dated Feb. 11, 1986) is an improvement relative to U.S. Pat. No. 4,293,033, since no spacer bar is required. In this more recent patent, there is provided a number of plates 30–36, each having a plurality of protuberances 40–46 projecting from one side only of the corresponding plate. In some plates, the protuberances are all directed downwardly, and so constitute depressions. Space use is thus more efficient than in the 1981 patent, but, in the opinion of the present inventors, this wall construction could still be improved with respect to the capacity of reduction of volume for storage before use.

OBJECTS OF THE INVENTION

Accordingly, it is an important object of the invention to facilitate storage of the wall structure materials before installation thereof.

An important object of the invention is to substantially increase the ease of assembling of the wall structure, which may be done where it is to be installed.

An object of the invention is to provide a wall structure having excellent heat exchanging properties, i.e. being of increased efficiency with respect to known heat exchanger walls.

An object of the invention is that said wall structure be lightweight and of sturdy construction.

SUMMARY OF THE INVENTION

In accordance with the teachings of the invention, there is disclosed a wall assembly consisting of at least an upper, an intermediate and a lower sheet of a rigid material, each sheet being poked with a plurality of similar protuberances and cavities extending on opposite sides of the virtual plane defined by the sheet in alternating fashion whereby each cavity is surrounded solely by protuberances and each protuberance is surrounded solely by cavities, and securing means to fixedly interconnect said sheets; wherein an upper and a lower layer of undulating channels are defined thicknesswisely of said wall assembly.

Preferably, a fourth sheet similar to the other said sheets is added below said lower sheet and fixedly secured thereto by said securing means, wherein a third layer of undulating channels is defined between said lower and fourth sheets.

Advantageously, said protuberances and cavities each defines a semi-spherical shape.

Preferably also, each protuberance of a given said sheet is surrounded by four equidistant cavities, and each cavity thereof is surrounded by four equidistant protuberances.

Advantageously, for a given said sheet, the distance between the center portion of two successive directly registering protuberances is thrice the radii of curvature of said cavities and protuberances, while the distance between the center portion of two successive protuberances across a cavity is between four and four times and a half said radii of curvature.

Profitably, the combined thickness of each sheet including its cavities and protuberances is about 1.25 times the radius of curvature of said cavities and protuberances.

It is envisioned that, alternately, said protuberances and cavities each defines a pyramidal shape.

Then, it would be desirable that said pyramidal shaped protuberances and cavities each defines four triangular plates, merging at an outer pyramidal tip and edgewisely integral at their bottom edge to the corresponding said sheet, the relative angle made between each pair of adjacent said plates being 90°.

Preferably, each of said channels is of constant cross-section along its entire length.

It would be advantageous that each sheet of the wall assembly be made from a flight-tight material, and said securing means are fluid-tight, each said channel being destined for passage of a fluid, said fluid channels destined for thermal exchanges therebetween, whereby said wall assembly would constitute a heat exchanger.

DETAILED DESCRIPTION OF THE INVENTION

Figure 1:
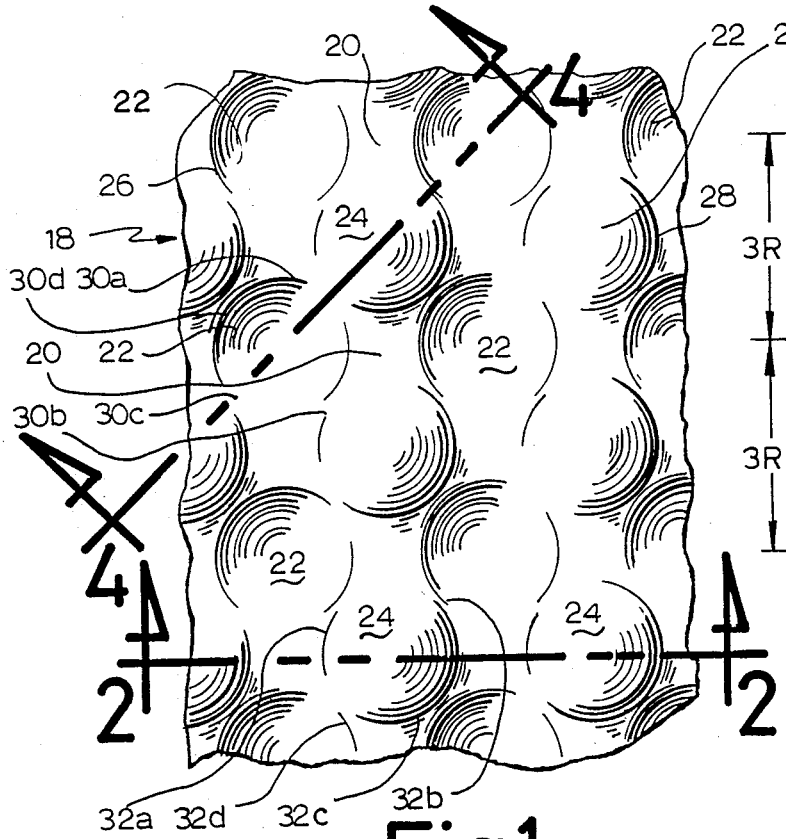
FIG. 1 is a plan view of one broken sheet from a heat exchanger wall assembly in accordance with a first embodiment of the invention.
Figure 3:
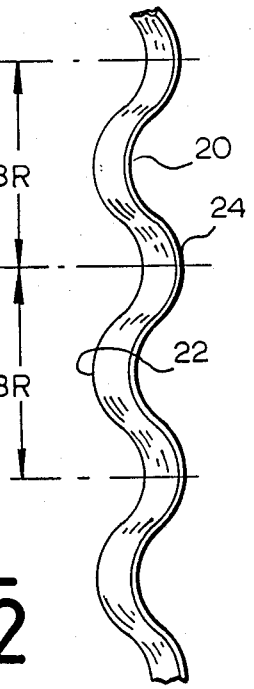
FIG. 3 is an edge view of said one sheet of wall assembly.
Figure 2:
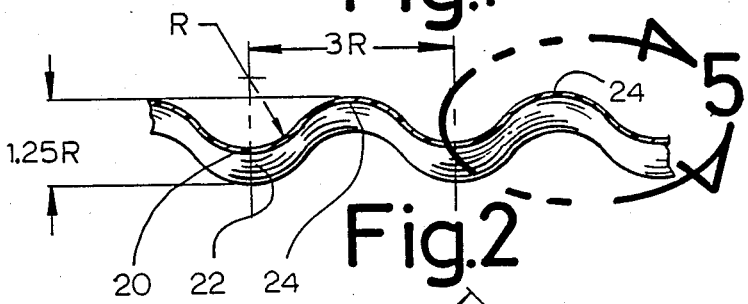
FIG. 2 is a cross-sectional view taken along oblique line 2—2 of FIG. 1.
Figure 4:
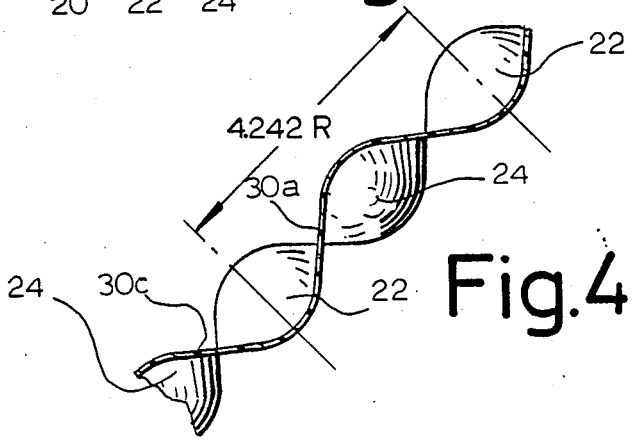
FIG. 4 is a cross-sectional view taken along transverse line 4—4 of FIG. 1.
Figure 5:
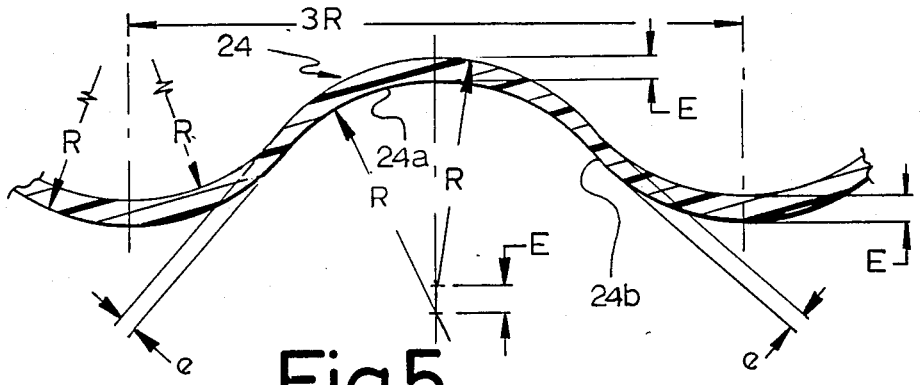
FIG. 5 is an enlarged view of the area circumscribed by circle 5 in FIG. 2.

Heat exchanger wall assemblies 14 and 16 of FIGS. 6–7 and 8–9 respectively, each consists of a few similar sheet layers, one being shown in FIGS. 1–5 at 18. Each sheet 18 has a length, width and small thickness, and extends about a virtual plane. Each sheet 18 is permanently embossed or poked with a plurality of semi-spherical downturned cavities 22 and upturned protuberances 24, extending beyond said virtual plane on opposite "top and bottom" sides thereof. Each cavity 22 defines a circular edge 26 coplanar to said sheet virtual plane, and similarly, each protuberance 24 defines a circular edge 28 coplanar to the sheet main surface 20. The cavities 22 and protuberances 24 of each wall 18 are arranged in alternating fashion with respect to each other, whereby each cavity is surrounded by four proximate cavities. The dimensions of wall cavities 22 are such that the circular edge 26 of each of these cavities tangentially intersects with the circular edges 28 of each of the four protuberances 24 adjacent thereof at 30*a*, 30*b*, 30*c*, 30*d* (FIG. 1). Intersection points 30*a*–30*d* of a given cavity 22 are substantially equidistant. Similarly, the dimensions of wall protuberances 24 are such that the circular edge 28 of each of these protuberances tangentially intersects with the circular edges 26 of each of the four cavities 22 adjacent thereof, at 32*a*, 32*b*, 32*c*, 32*d*. Intersection points 32*a*–32*d* of a given protuberance 24 are equidistant. Protuberances 24 are thus arranged in colinear, lengthwise, laterally-spaced rows and in colinear, widthwise, lengthwisely-spaced columns; similarly, cavities 22 are arranged in colinear, lengthwise, laterally-spaced rows and in colinear, widthwise lengthwisely-spaced columns.

Therefore, wall 18 is of sinusoidal shape in sectional view. Preferably, the length of one cycle or "wavelength" of the sinusoidal wall 18 is three times the radius of curvature R of a protuberance 24 (which is preferably the same as that of a cavity 22), about a widthwise or lengthwise axis, this cycle length is increased to about 4.242 R for an oblique axis passing through intersection points 30*a*–30*d*/32*a*–32*d* of the cavities/protuberances circular edges. Preferably also, the amplitude of the "wave" made by sinusoidal wall 18 is about 1.25 R. Preferably also, the thickness E (FIG. 5) of wall sheet 18 at the trough portion 24*a* of each protuberance 24 is greater than its thickness "e" at the remaining portions of protuberance 24; this should also be true for the trough portions 22*a* of each cavity 22.

Figure 6:
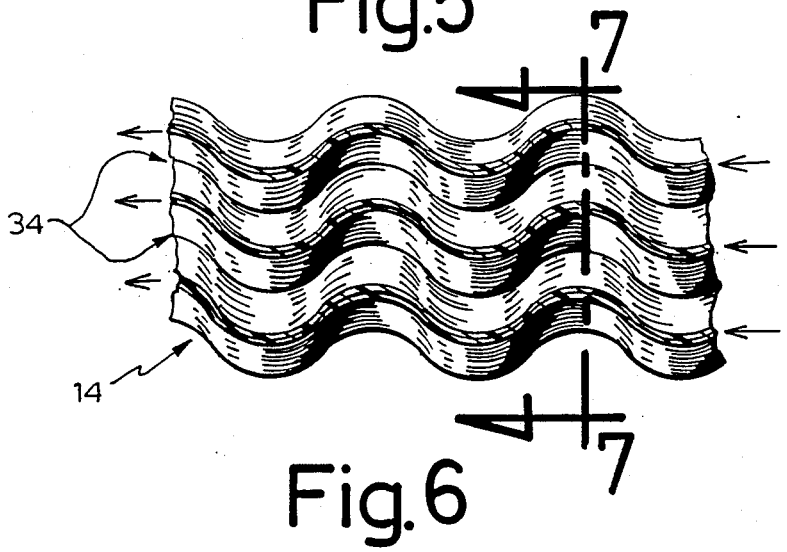
FIGS. 6 and 7 are sectional views taken orthogonally of each other of a first embodiment of heat exchanger wall assembly of the invention.
Figure 7:
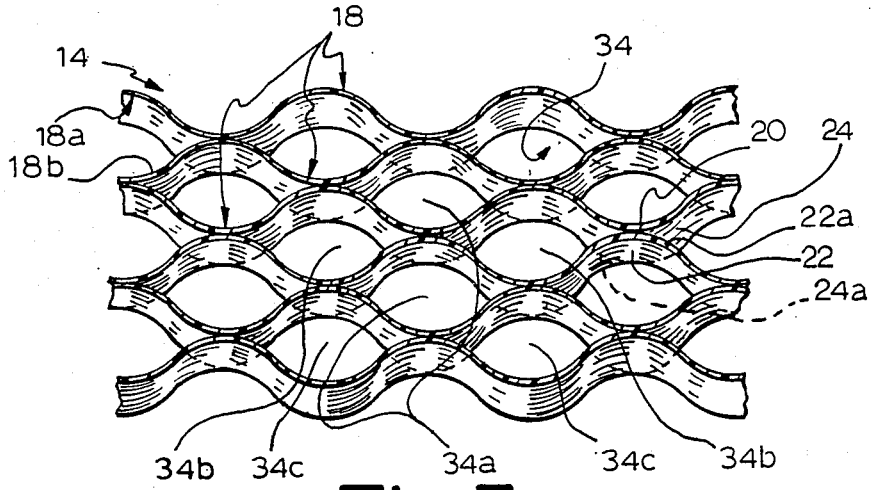

With reference to FIGS. 6–7, the heart of the invention lies in the construction of at least three, and preferably at least four layers of sheets 18 being interconnected by glue or other suitable means, in the following fashion:

(a) the trough 22*a* of each cavity 22 of an overlying sheet, 18*a* e.g., is abuttingly secured to the crest 24*a* of the projection 24 of the underlying sheet 18*b*;

(b) the projection 24 of said topmost sheet 18*a* faces the cavities 22 of the next lowermost sheet 18*b*, and similarly for the following adjacent pairs of sheets; and the cavities 22 of the lowermost sheet faces the protuberances 24 of the next higher sheet, and so on upwardly by adjacent pairs.

Hence, a plurality of parallel, sealed flow channels 34 are defined, for through passage of fluids sealing from each other fluid. Each channel 34 has a sinusoidal or undulating, winding path of travel and a substantially constant cross-sectional shape along its length, this latter cross-sectional shape resembling two mirror-image Gaussian or normal Bell curves. Five layers of channels 34 are defined in FIG. 7 for six walls or sheets 18. Due to its construction, the wall assembly 14 therefore facilitates thermal exchanges of a fluid passing through one passageway 34*a*, both with a fluid passing through two upper layer channels 34*b*, 34*b*, and with a fluid passing through two lower layer channels 34*c*, 34*c*. The efficiency of thermal exchanges is thus maximized for fluids passing through intermediate layers of channels 34 thicknesswisely of wall assembly 14.

The high efficiency of wall assembly 14 can be explained by the fact that very near to 100% of the wall surfaces of channels 34*a* are in direct contact with the fluids flowing through the four other overlying and underlying channels 34*b*, 34*b*, 34*c*, 34*c*. Indeed, the only parts which do not promote thermal exchange between different fluids are the four contact points 30*a*–30*d*/-32*a*–32*d*, which interconnect the superimposed wall layers 18.

Figure 8:
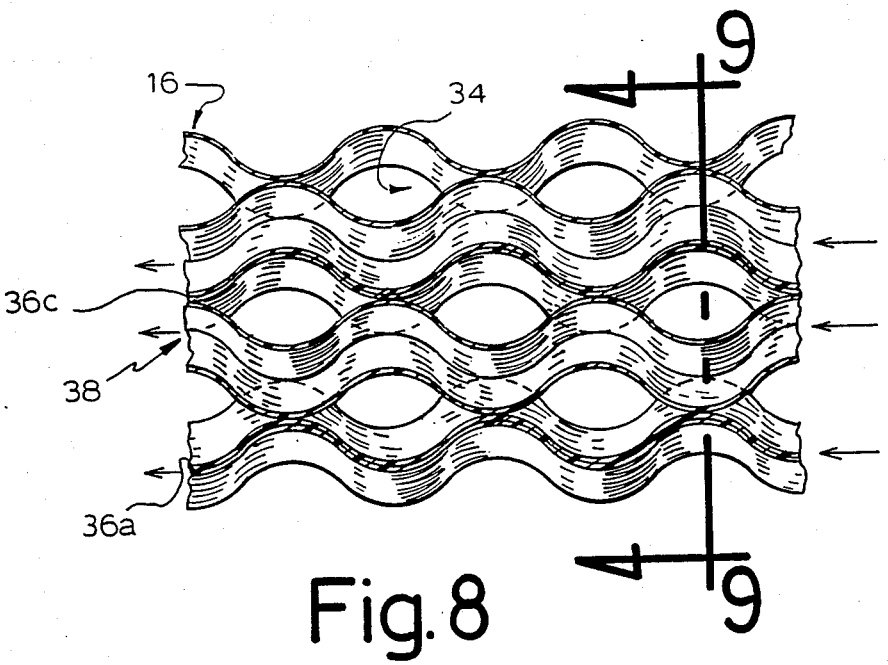
FIGS. 8 and 9 are sectional views taken orthogonally of each other of a second embodiment of heat exchanger wall assembly of the invention.
Figure 9:
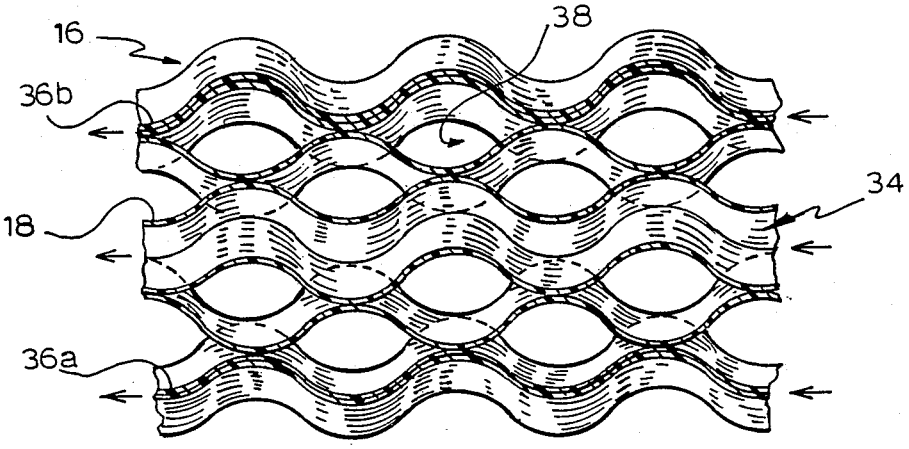
Figure 10:
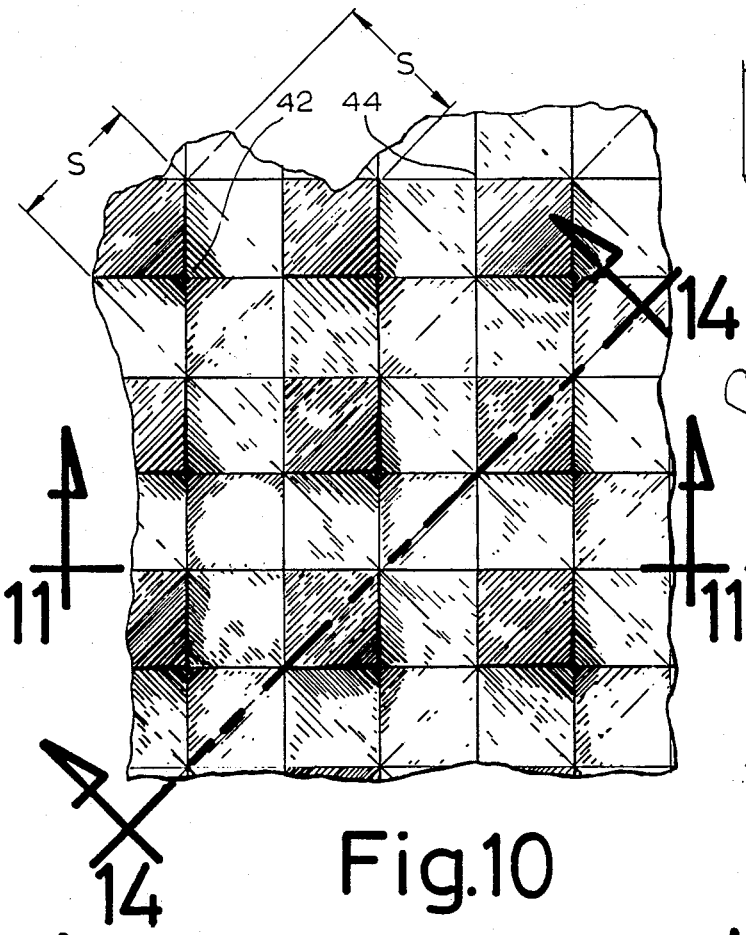
FIG. 10 is a plan view of one broken sheet from a heat exchanger wall assembly in accordance with a second embodiment of the invention.
Figure 12:
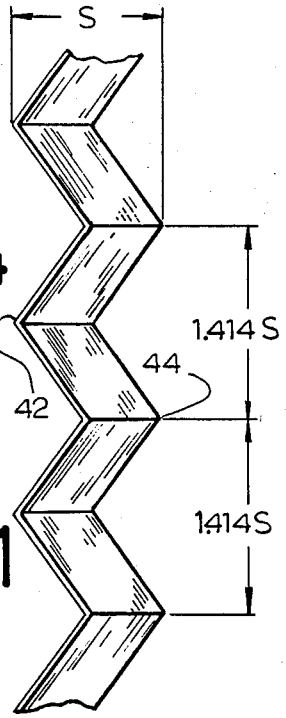
FIG. 12 is an edge view of the wall assembly of FIG. 11.
Figure 11:
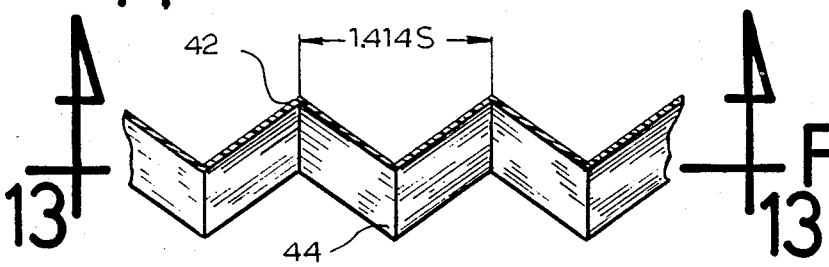
FIG. 11 is a cross-sectional view taken along line 11—11 of FIG. 10.

The second embodiment of the wall assembly, 16, shown in FIGS. 8–9, is similar to the first one except for two features:

(a) some sheet layers consist of a double wall layer 36*a*, 36*b*, for additional thermal insulation between exterior ambient air and the channel fluids, or to prevent thermal exchanges between some channels of different layers which would not be deemed desirable;

(b) one or more layers of fluid channel(s) 38, at an intermediate thicknesswise section of wall assembly 16, may extend along a path of travel at right angle to that of the remaining layers of fluid channels 34.

In the second embodiment of wall sheets shown at 40 in FIGS. 10–18, the semi-spherical projections and cavities are replaced by pyramidal projections and cavities, 42, 44 alternating with respect to one another. Thus, each pyramidal projection 42 is surrounded on the same sheet 46 by four pyramidal cavities 44, and each of the latter is surrounded by four pyramidal projections 42. Hence, each pyramid 42 or 44 consists of four triangular plates merging at the pyramidal tip 42*a* or 44*a* at one end, and edgewisely to the sheet 46 at the other end. The relative angle between each pair of adjacent walls in a pyramid 42 or 44 is preferably 45°.

Figure 13:
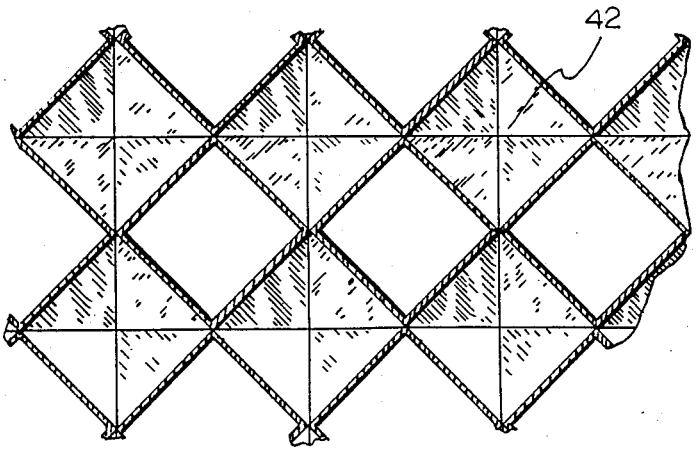
FIG. 13 is a sectional view taken along line 13—13 of FIG. 11.
Figure 14:
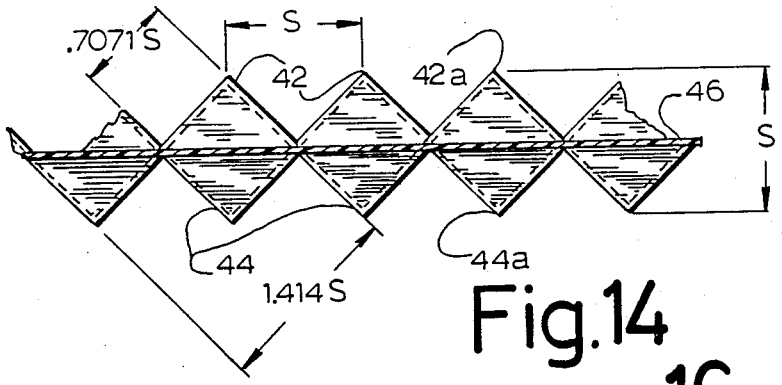
FIG. 14 is a cross-sectional view taken along line 14—14 of FIG. 10.

It is understood from FIGS. 13–14 that undulating fluid travel paths 48 will be created by applying a few sheets 40 one against the other in a wall assembly 50 in the same general way as in the first and second wall assemblies of FIGS. 6–9, i.e. with respect to the relative position of projections and cavities for two adjacent sheets 40, 40. In wall assembly 50, all the undulating fluid paths 48 are parallel to each other (as in FIGS. 6–7 for the first embodiment of wall assembly).

Figure 15:
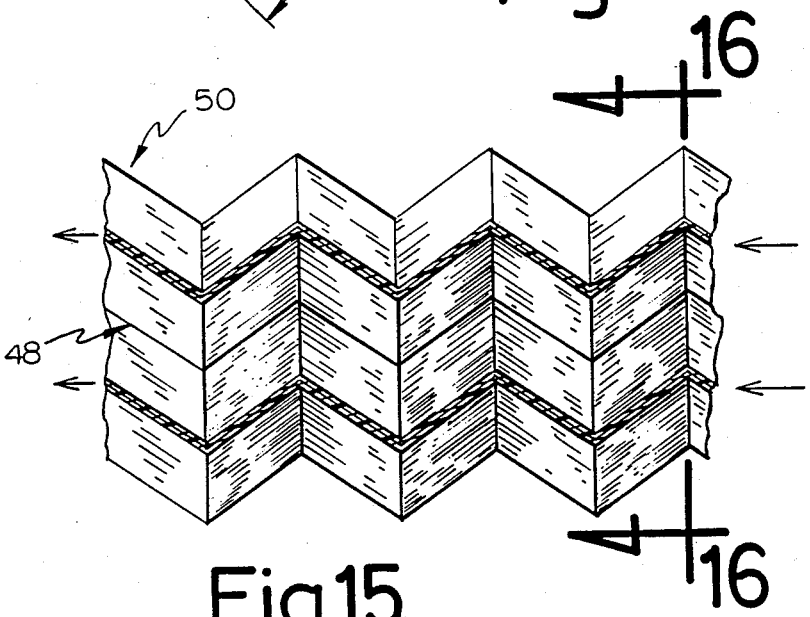
FIGS. 15–16 are sectional views taken orthogonally of each other of a third embodiment of wall assembly of the invention.
Figure 16:
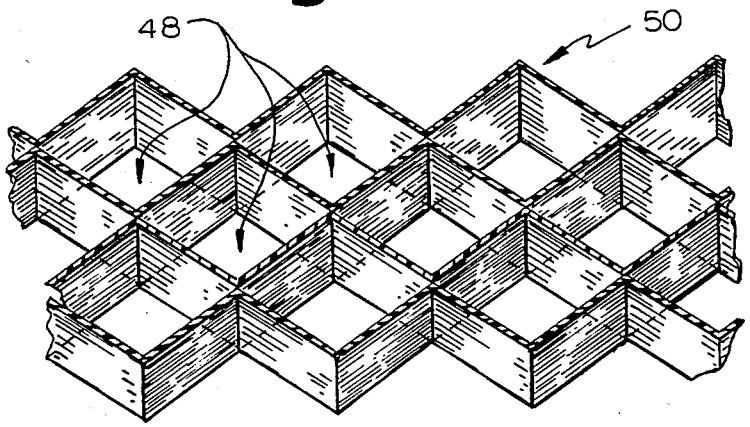
Figure 17:
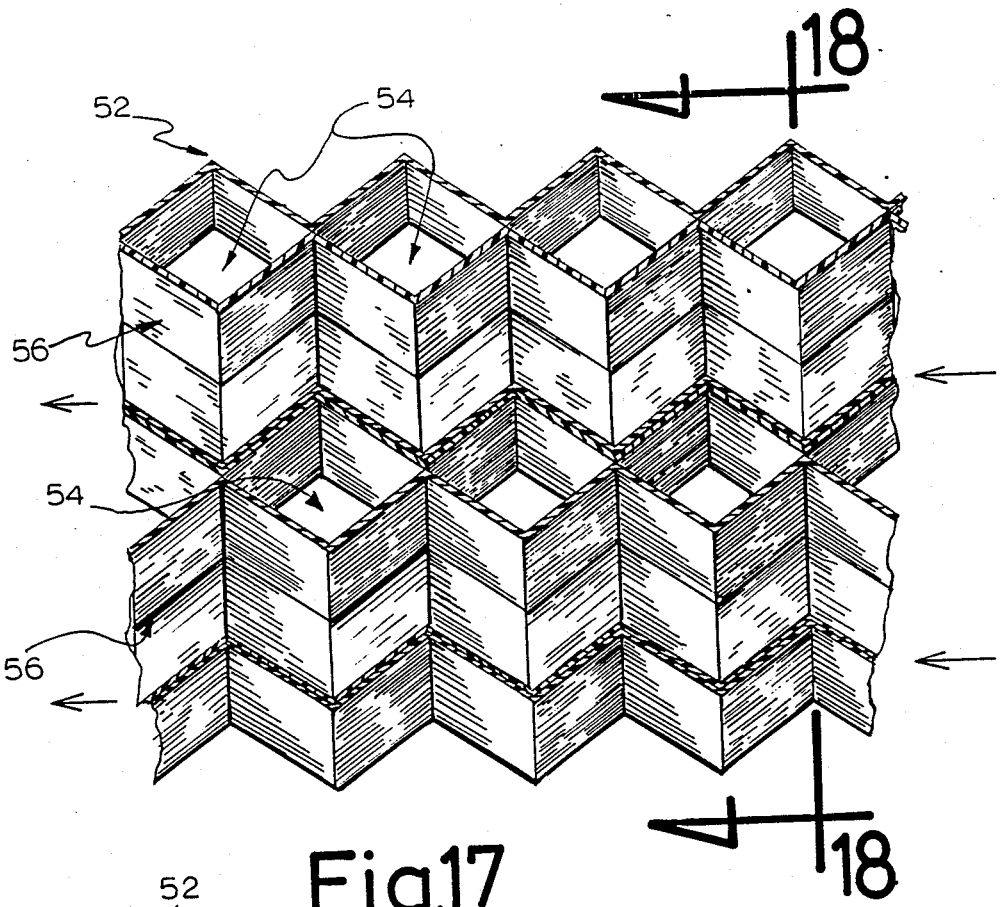
FIGS. 17–18 are sectional views taken orthogonally of each other of a last embodiment of heat exchanger wall assembly according to the invention.
Figure 18:
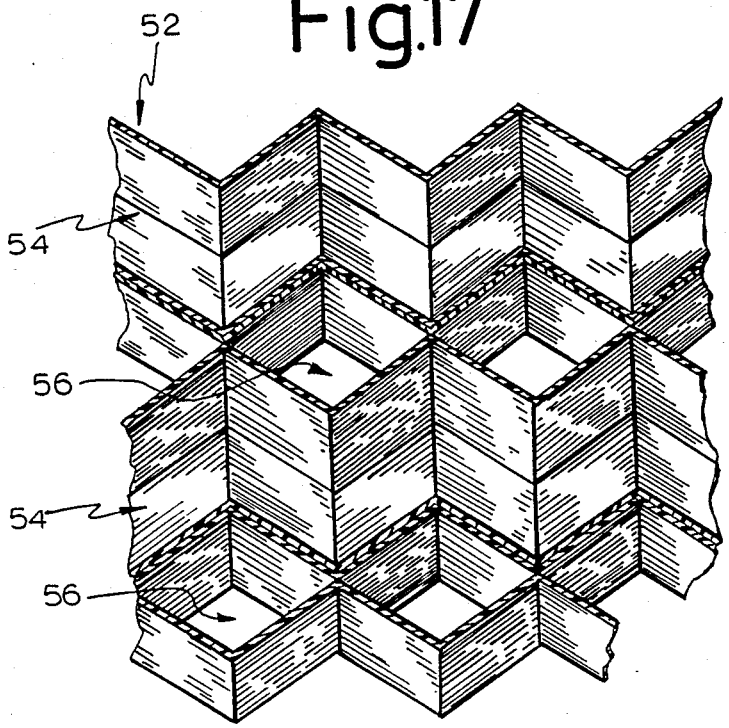

In the fourth embodiment of wall assembly shown as 52 in FIGS. 15–16, some fluid passages 54 extend in one direction while the fluid passages 56 from wall sheets 40 adjacent those of passages 54 extend in a direction orthogonal to that of passages 56, as clearly illustrated in the figures.

Any type of suitable rigid material may be used for making the walls, e.g. a plastic material, and be assembled with glue, welding or by mechanical securing (e.g. screw) means.

It is envisioned that the present wall assembly be suitable for a wide range of applications, including: wall structures constituting the skin of aircrafts, spacecrafts, boats, and automobiles; walls and anti-skid floorings of buildings; generally speaking, all heat exchanger apparatuses; insulating panels; acoustical panels; packing sheets for packing manufactured products before expedition; mechanical structural beams; fluid tanks; damper structures, e.g. containers for hazardous products capable of sustaining and dampening heavy mechanical blows; anti-radiation products containers, e.g. for sand or lead; and other applications.

It is to be understood that said virtual plane of the sheets 18 constituting the heat exchanger wall structure need not be straight or flat, wherein it may be bent or curved to follow the contour associated with the desired purpose, e.g. to conform to the variably-curved shape required for making the skin of the fuselage of an aircraft.

Moreover, the present wall structure could also be used as a simple wall which would not necessarily be subjected to heat transfers. Indeed, the expansion capability from its storage condition, in which all sheets thereof flatly abut against each other, with the projections nesting in the corresponding cavities), to its operation position, in which the interconnected sheets are spread apart and glued or otherwise secured in their operative position, to define a relatively thick but sturdy and lightweight, thicknesswisely-open wall structure, constitutes per se an advantageous and innovative feature, in accordance with the teachings of the invention.

We claim:

1. A wall assembly consisting of at least an upper, an intermediate and a lower sheet of a rigid material, each sheet being poked with a plurality of similar protuberances and cavities extending on opposite sides of the virtual plane defined by the sheet in alternating fashion whereby each cavity is surrounded solely by protuberances and each protuberance is surrounded solely by cavities, and securing means to fixedly interconnect said sheets; wherein an upper and a lower layer of channels are defined, undulating in a direction normal to said sheets, each of said channels being of constant cross-section along its entire length .

2. A wall assembly as defined in claim 1, wherein a fourth sheet similar to the other said sheets is added below said lower sheet and fixed secured thereto by said securing means, wherein a third layer of undulating channels is defined between said lower and fourth sheets.

3. A wall assembly as defined in claim 1, wherein said protuberances and cavities each define a semispherical shape.

4. A wall assembly as defined in claim 1, wherein said protuberances and cavities each defines a pyramidal shape.

5. A wall assembly as defined in claim 1, wherein each protuberance of a given said sheet is surrounded by four equidistant cavities, and each cavity thereof is surrounded by four equidistant protuberances.

6. A wall assembly of defined in claim 3, wherein, for a given said sheet, the distance between the center portion of two successive, directly-registering protuberances is thrice the radii of curvature of said cavities and protuberances, while the distance between the center portion of two successive protuberances across a cavity is between four and four times and a half said radii of curvature.

7. A wall assembly as defined in claim 3, wherein the combined thickness of each sheet including its cavities and protuberances is about 1.25 times the radius of curvature of said cavities and protuberances.

8. A wall assembly as defined in claim 4, wherein said pyramidal-shaped protuberances and cavities each defines four triangular plates, merging at an outer pyramidal tip and edgewisely integral at their bottom edge to the corresponding said sheet, the relative angle made between each pair of adjacent said plates being 90°.

9. A wall assembly as defined in claim 1, wherein each sheet is made from a fluid-tight material, said securing means being fluid-tight, each said channel is destined for passage of a fluid, said fluid channels destined for thermal exchanges therebetween, whereby said wall assembly constitutes a heat exchanger.

* * * * *